US010977975B2

(12) United States Patent
Feng et al.

(10) Patent No.: US 10,977,975 B2
(45) Date of Patent: Apr. 13, 2021

(54) PIXEL STRUCTURE OF ELECTRONIC PAPER, METHOD FOR DRIVING THE SAME, ELECTRONIC PAPER, AND DISPLAY DEVICE

(71) Applicants: Beijing BOE Optoelectronics Technology Co., Ltd., Beijing (CN); BOE Technology Group Co., Ltd., Beijing (CN)

(72) Inventors: Dawei Feng, Beijing (CN); Yue Li, Beijing (CN)

(73) Assignees: Beijing BOE Optoelectronics Technology Co., Ltd, Beijing (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/396,834

(22) Filed: Apr. 29, 2019

(65) Prior Publication Data

US 2020/0074904 A1 Mar. 5, 2020

(30) Foreign Application Priority Data

Aug. 30, 2018 (CN) ..... 201811004319.6

(51) Int. Cl.
*G09G 3/20* (2006.01)

(52) U.S. Cl.
CPC ..... *G09G 3/20* (2013.01); *G09G 2300/043* (2013.01); *G09G 2300/0426* (2013.01); *G09G 2300/0439* (2013.01)

(58) Field of Classification Search
None
See application file for complete search history.

(56) References Cited

U.S. PATENT DOCUMENTS 4,955,697 A * 9/1990 Tsukada ..... G02F 1/136213 349/38
6,781,643 B1 * 8/2004 Watanabe ..... G02F 1/136213 349/38
7,176,880 B2 * 2/2007 Amundson ..... G02F 1/136213 345/107
8,169,391 B2 * 5/2012 Lee ..... G09G 3/3659 345/214
8,416,168 B2 * 4/2013 Cho ..... G09G 3/3607 345/90
10,139,691 B2 * 11/2018 Wu ..... G02F 1/13306
10,192,503 B2 * 1/2019 Fujikawa ..... G02F 1/13454
10,274,803 B2 * 4/2019 Kimura ..... G09G 3/344
10,444,583 B2 * 10/2019 Seong ..... G02F 1/136286
(Continued)

*Primary Examiner* — Chad M Dicke
(74) *Attorney, Agent, or Firm* — Arent Fox LLP; Michael Fainberg

(57) ABSTRACT

The disclosure relates to a pixel structure, a method for driving the same, electronic paper, and a display device, where compensation electrodes electrically connected in correspondence with respective pixel electrodes are additionally arranged, and there are overlapping areas between orthographic projections of the compensation electrodes unto a base substrate, and orthographic projections of gate lines onto the base substrate. Furthermore the compensation electrodes corresponding to the n-th row of pixel electrodes are connected with second electrodes of corresponding first switch transistors, and gates and first electrodes of the first switch transistors are connected with the (n−1)-th gate line.

10 Claims, 6 Drawing Sheets

(56) References Cited

U.S. PATENT DOCUMENTS

2007/0091217 A1* 4/2007 Zhang ..... H01L 29/78696
349/6
2007/0108443 A1* 5/2007 Kim ..... H01L 27/3244
257/40
2008/0198290 A1* 8/2008 Su ..... G02F 1/13624
349/48
2009/0009458 A1* 1/2009 Bae ..... G09G 3/3607
345/92
2011/0043498 A1* 2/2011 Tsubata ..... G02F 1/13624
345/204
2012/0268357 A1* 10/2012 Shih ..... G09G 3/3607
345/88
2014/0043554 A1* 2/2014 No ..... G02F 1/136227
349/43
2014/0253426 A1* 9/2014 Leoni ..... G02F 1/167
345/107
2016/0203789 A1* 7/2016 Lee ..... G09G 3/3648
345/690
2017/0170200 A1* 6/2017 Ikeda ..... G09G 3/2003

* cited by examiner

PIXEL STRUCTURE OF ELECTRONIC PAPER, METHOD FOR DRIVING THE SAME, ELECTRONIC PAPER, AND DISPLAY DEVICE

CROSS-REFERENCE TO RELATED APPLICATION

This application claims priority of Chinese Patent Application No. 201811004319.6, filed on Aug. 30, 2018, which is hereby incorporated by reference in its entirety.

FIELD

The present disclosure relates to the field of display technologies, and particularly to a pixel structure, a method for driving the same, electronic paper, and display device.

BACKGROUND

As the digital technologies are advancing, more and more display devices spreading information have stepped into our life, and for example, a liquid crystal display has been widely applied to communication, information, and consumer electronic products, but the liquid crystal display shall be powered constantly to display information, so there is a significant advantage of Electronic Paper (EP) capable of displaying information for a long period of time even after it is powered off, and also the electronic paper in operation consumes less power than the liquid crystal display.

The electronic paper displays information electrophoretically in such a way that charged particles are driven by an electric field created between pixel electrodes and common electrodes to move up and down, and the charged particles in different colors reflect ambient light to provide a number of display schemes including black-white, black-white-red, multi-colors, etc.

SUMMARY

Some embodiments of the disclosure provide a pixel structure of electronic paper, the pixel structure including: an base substrate, N number of rows of pixel electrodes located on the base substrate, and N number of gate lines connected with the respective rows of pixel electrodes in a one-to-one manner, the respective gate lines being located on upper or lower sides of their corresponding rows of pixel electrodes, wherein the pixel structure further includes: compensation electrodes connected in correspondence with the respective pixel electrodes, and first switch transistors arranged corresponding to the respective compensation electrodes in a one-to-one manner, wherein:

the compensation electrodes corresponding to the n-th row of pixel electrodes are arranged on the side of the (n−1)-th row of pixel electrodes proximate to the (n−1)-th gate line, and there are overlapping areas between orthographic projections of the compensation electrodes corresponding to the n-th row of pixel electrodes onto the base substrate and a orthographic projection of the (n−1)-th gate line onto the base substrate, wherein n is an integer greater than 1, and less than or equal to N; N is an integer greater than 1, and the compensation electrodes corresponding to the n-th row of pixel electrodes are connected with second electrodes of the corresponding first switch transistors, and gates and first electrodes of the first switch transistors are connected with the (n−1)-th gate line.

Optionally, in the pixel structure according to embodiments of the disclosure, the compensation electrodes are arranged on a layer same as a layer on which the pixel electrodes are, and made of a material same as a material of which the pixel electrodes are made.

Optionally, in the pixel structure according to embodiments of the disclosure, the compensation electrodes are structured integral to their corresponding pixel electrodes.

Optionally, in the pixel structure according to embodiments of the disclosure, the pixel structure further includes: second switch transistors corresponding to the respective compensation electrodes in a one-to-one manner, wherein:

the compensation electrodes are connected with their corresponding pixel electrodes through their corresponding second switch transistors; and the compensation electrodes corresponding to the n-th row of pixel electrodes are connected with second electrodes of the corresponding second switch transistors, and the second switch transistors have first electrodes electrically connected with the n-th row of pixel electrodes and gates connected with the n-th gate line.

Optionally, in the pixel structure according to embodiments of the disclosure, layers with a same function in the first switch transistors and the second switch transistors are arranged at a same layer.

Optionally, in the pixel structure according to embodiments of the disclosure, widths of the compensation electrodes in a column direction completely cover widths of the gate lines gate in a column direction.

Optionally, in the pixel structure according to embodiments of the disclosure, the pixel structure further includes: third switch transistors corresponding to the respective pixel electrodes in a one-to-one manner, and data lines corresponding to the respective columns of pixel electrodes, wherein:

the n-th row of pixel electrodes are connected with second electrodes of their corresponding third switch transistors, and the third switch transistors have gates connected with the n-th row gate line, and first electrodes connected with the corresponding data line.

Correspondingly, some embodiments of the disclosure further provide electronic paper including the pixel structure above according to embodiments of the disclosure.

Correspondingly, some embodiments of the disclosure further provide a display device including the electronic paper above according to embodiments of the disclosure.

Correspondingly, some embodiments of the disclosure further provide a method for driving the pixel structure above according to embodiments of the disclosure, the method including:

providing a scan signal to the respective gate lines in sequence, wherein:

while the scan signal is being provided to the n-th gate line, the n-th row of pixel electrodes are connected with corresponding compensation electrodes, and the compensation electrodes corresponding to the (n+1)-th row of pixel electrodes are connected with the n-th gate line, wherein n is any integer greater than 1, and less than or equal to N.

DETAILED DESCRIPTION OF THE EMBODIMENTS

Figure 1:
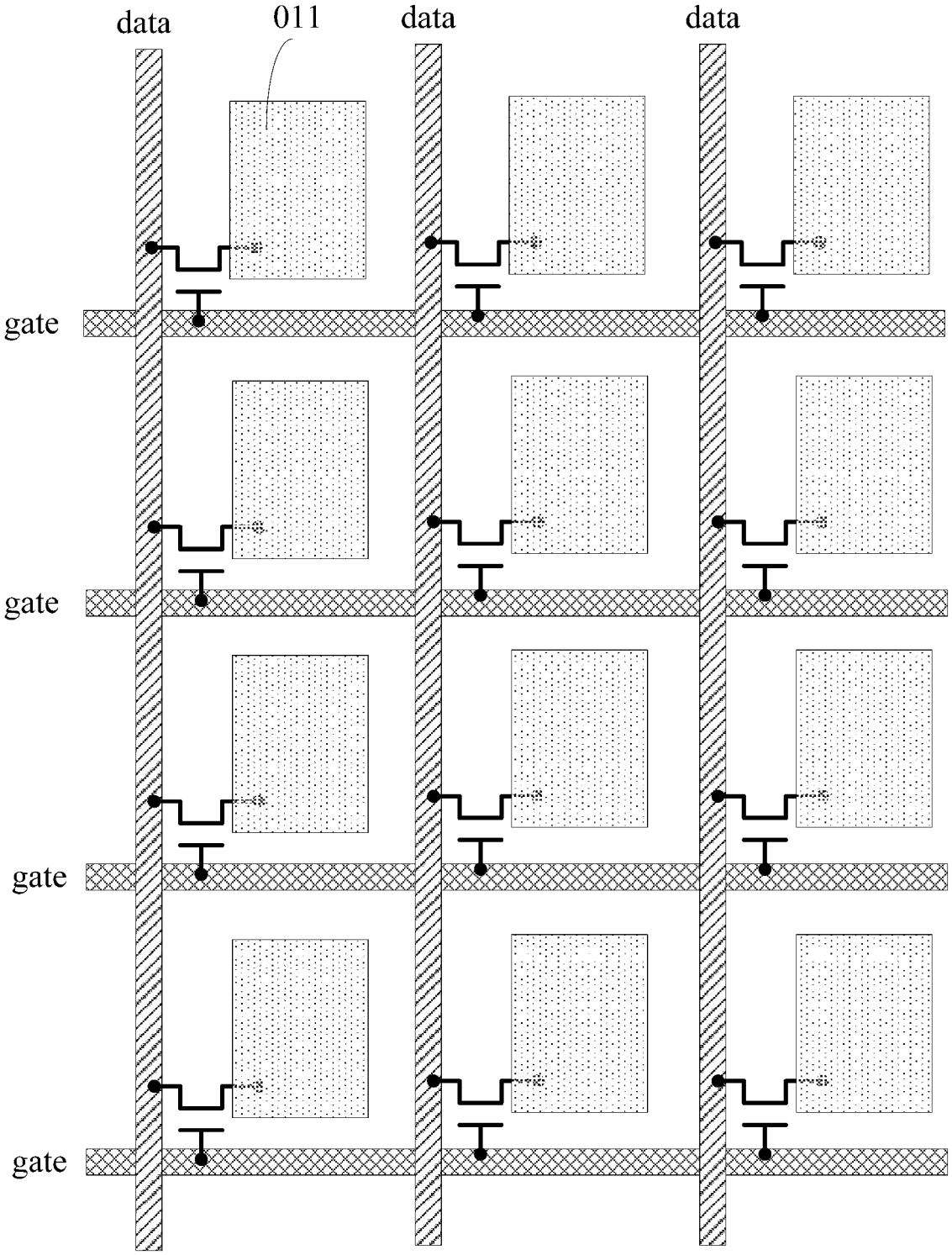
FIG. 1 is a schematic diagram of the pixel structure of the electronic paper in the related art.

In order to make the objects, technical solutions, and advantages of the disclosure more apparent, the disclosure will be described below in further details with reference to the drawings. Apparently the embodiments to be described are only a part but all of the embodiments of the disclosure. Based upon embodiments here of the disclosure, all of other embodiments which can occur to those ordinarily skilled in the art without any inventive effort shall come into the scope of the disclosure as claimed.

The shapes and sizes of respective components in the drawings are not intended to reflect any real proportion, but only intended to illustrate the disclosure of the disclosure.

At present, pixels of the electronic paper are structured as illustrated in FIG. 1, where pixel electrodes 011 are located in zones defined by data lines "data" and gate lines "gate", and connected with Thin Film Transistors (TFTs) to drive the charge particles directly. In order to guarantee a display effect of the pixels, some distance is maintained between the pixel electrodes 011, and the gate lines "gate" and data lines "data" to thereby avoid the voltage of the pixels from being disturbed by the capacitive-coupling effect, which would otherwise have resulted in display abnormality, and also lower loads on the gate lines "gate" and data lines "data" so as to enable the pixels to be charged. Although the display effect can be satisfied, an opening ratio may be degraded.

Figure 2:
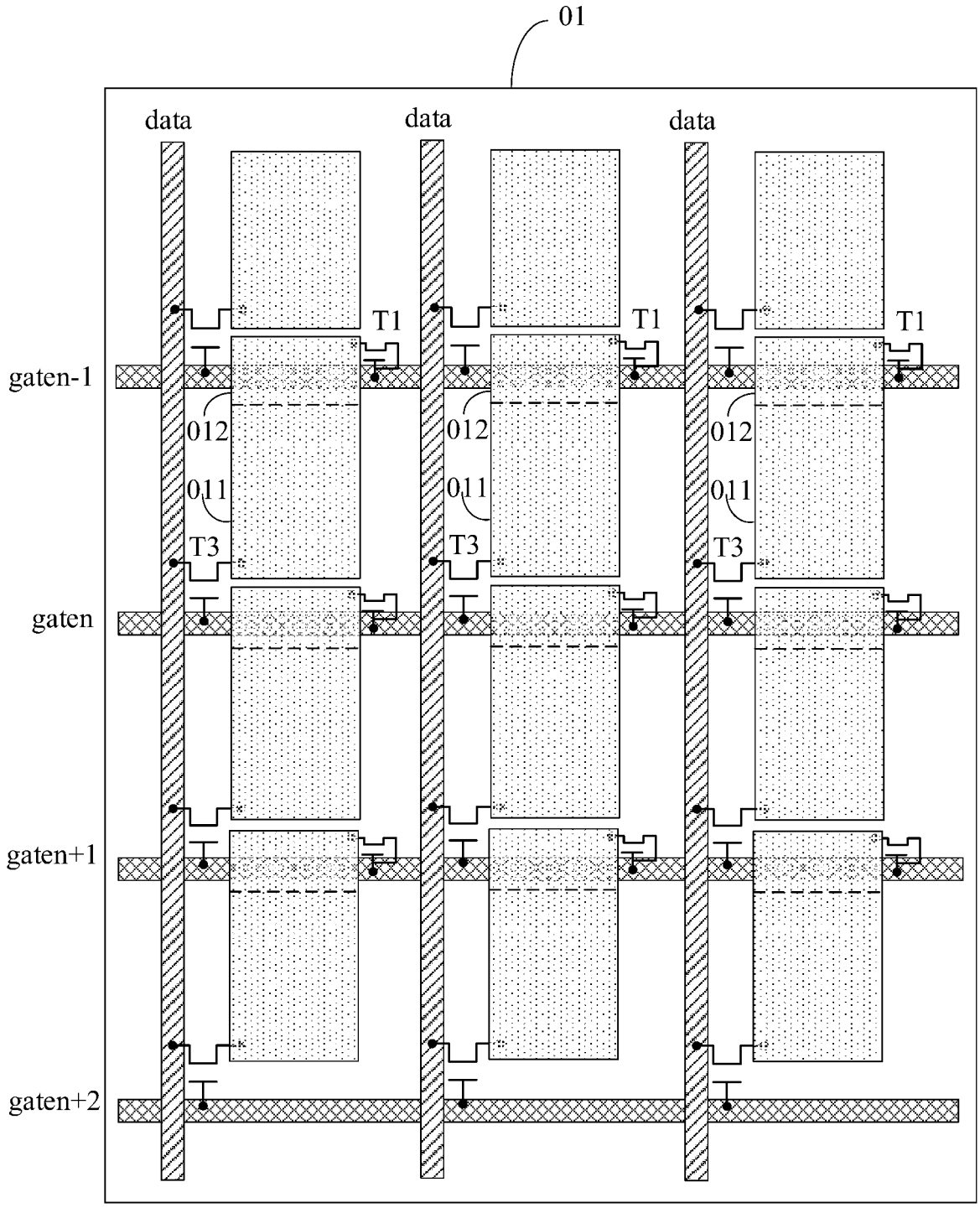
FIG. 2 is a schematic diagram of a pixel structure according to some embodiments of the disclosure.
Figure 3:
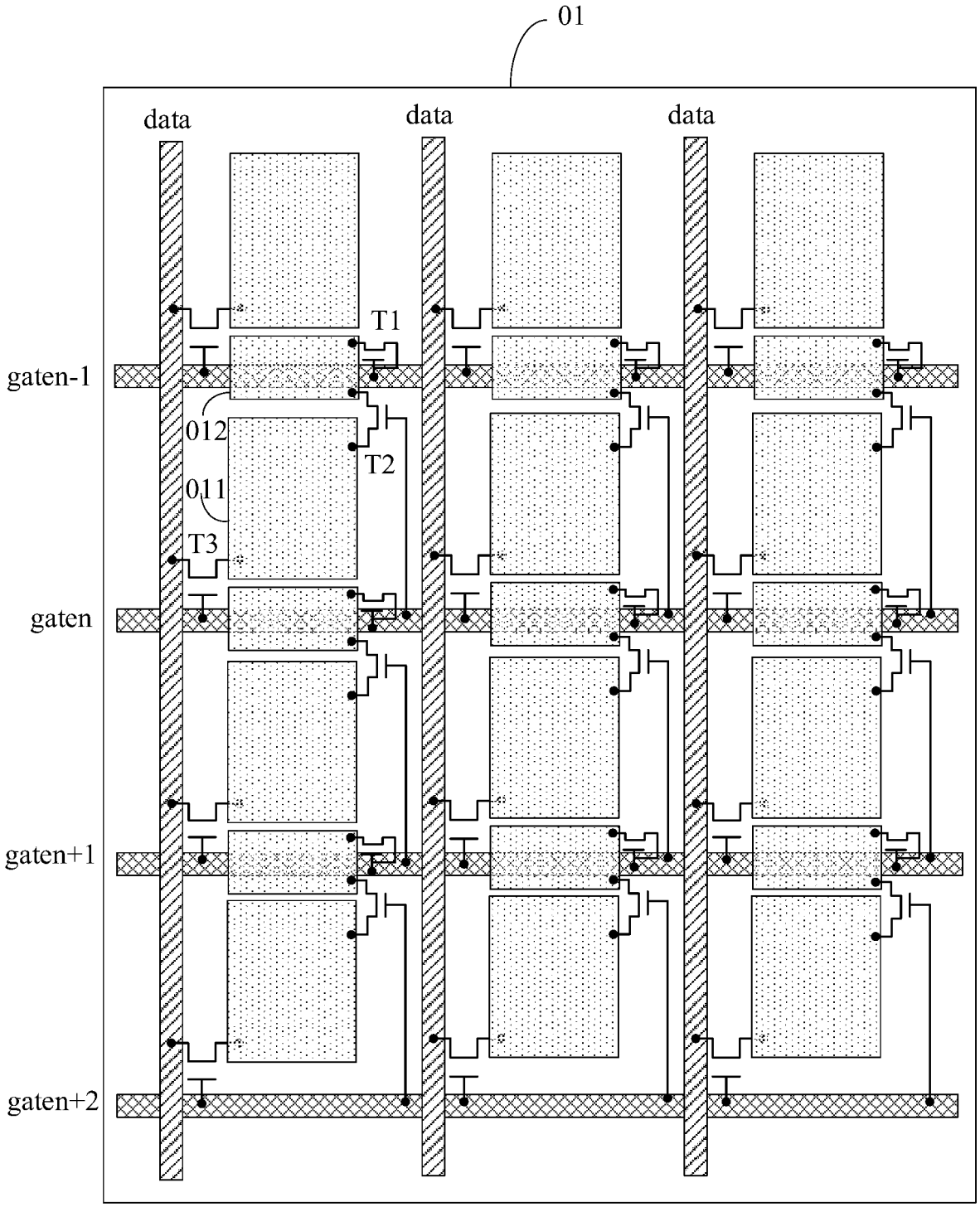
FIG. 3 is a schematic diagram of a pixel structure according to other embodiments of the disclosure.
Figure 4:
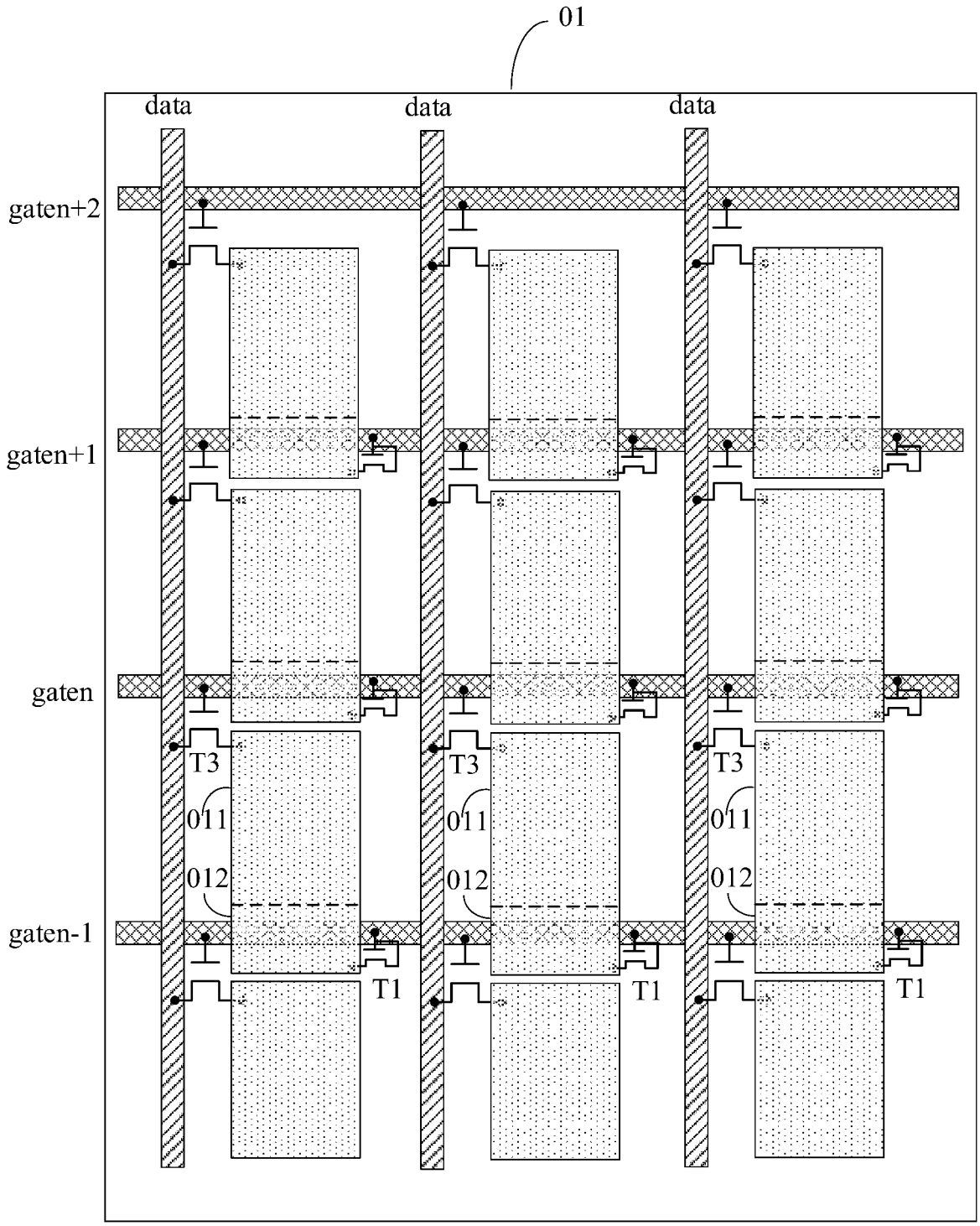
FIG. 4 is a schematic diagram of a pixel structure according to further embodiments of the disclosure.
Figure 5:
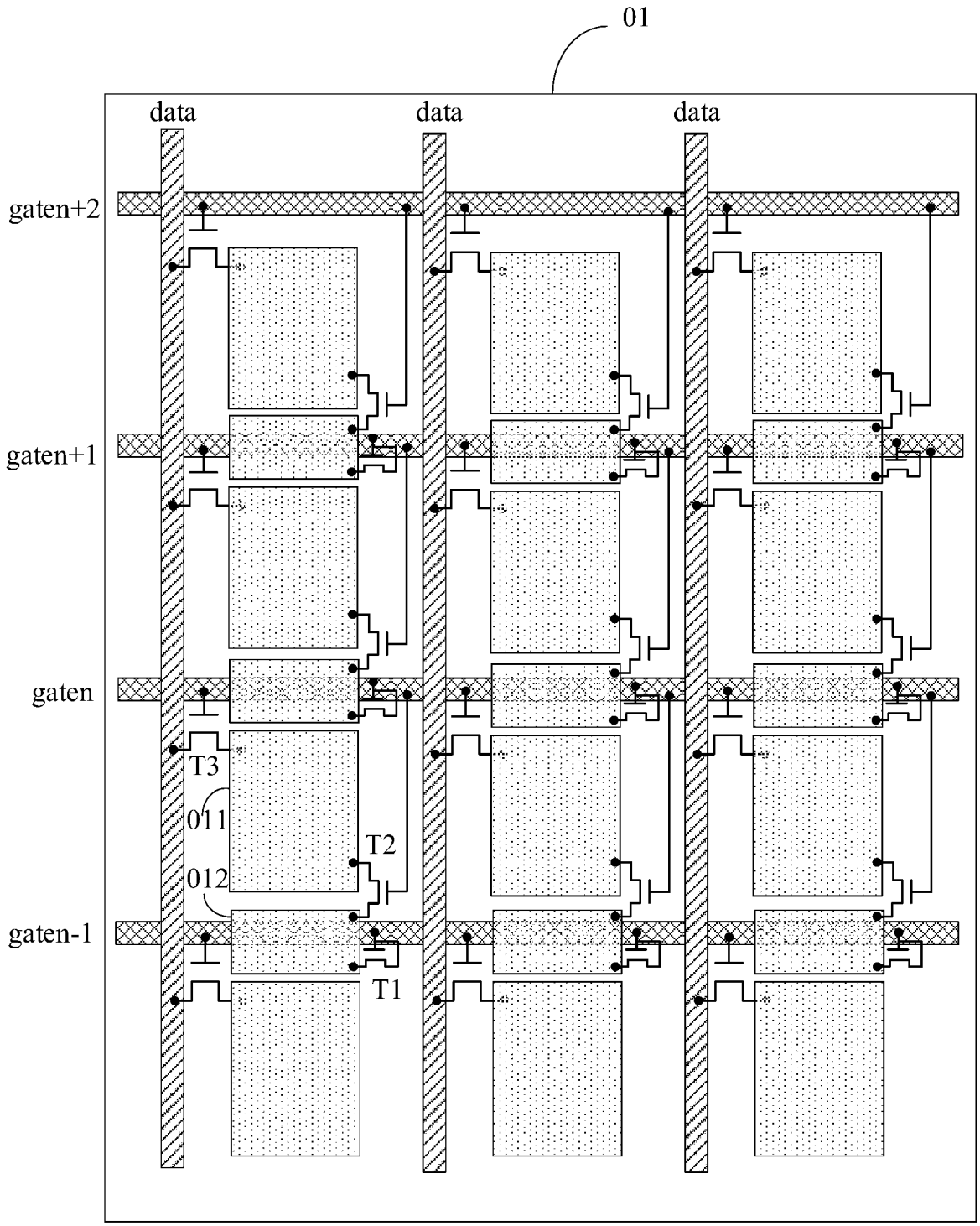
FIG. 5 is a schematic diagram of a pixel structure according to further embodiments of the disclosure.

As illustrated in FIG. 2 to FIG. 5, a pixel structure of electronic paper according to some embodiments of the disclosure includes: a base substrate 01, N rows of pixel electrodes 011 located on the base substrate 01, and N gate lines gaten connected with the respective rows of pixel electrodes 011 in a one-to-one manner; and as illustrated in FIG. 2 and FIG. 3, the respective gate lines gaten are located on lower sides of their corresponding rows of pixel electrodes 011, or as illustrated in FIG. 4 and FIG. 5, the respective gate lines gaten are located on upper sides of their corresponding rows of pixel electrodes 011.

The pixel structure further includes: compensation electrodes 012 connected in correspondence with the respective pixel electrodes 011, and first switch transistors T1 arranged corresponding to the respective compensation electrodes 012 in a one-to-one manner.

The compensation electrodes 012 corresponding to the n-th row of pixel electrodes 011 are arranged on the side of the (n−1)-th row of pixel electrodes 011 proximate to the (n−1)-th gate line gaten−1, and there are overlapping areas between orthographic projections of the compensation electrodes 012 corresponding to the n-th row of pixel electrodes 011 onto the base substrate 01, and an orthographic projection of the (n−1)-th gate line gaten−1 onto the base substrate 01, where n is any integer greater than 1, and less than or equal to N.

The compensation electrodes 012 corresponding to the n-th row of pixel electrodes 011 are connected with second electrodes of the corresponding first switch transistors T1, and gates and first electrodes of the first switch transistors T1 are connected with the (n−1)-th gate line gaten−1.

In the pixel structure according to embodiments of the disclosure, the compensation electrodes electrically connected in correspondence with the respective pixel electrodes are additionally arranged, and there are overlapping areas between the orthographic projections of the compensation electrodes unto the base substrate, and the orthographic projections of the gate lines onto the base substrate, that is, the areas of the pixel electrodes are increased using the compensation electrodes to thereby improve an opening ratio. Furthermore, the compensation electrodes corresponding to the n-th row of pixel electrodes are connected with the second electrodes of the corresponding first switch transistors, and the gates and the first electrodes of the first switch transistors are connected with the (n−1)-th gate line, so that during a scan on the (n−1)-th gate line, since the compensation electrodes with areas facing the gate line are connected with the gate line, there is the same voltage of the additional compensation electrodes as the gate line despite the areas thereof facing the gate line, so there is no coupling capacitance between the gate line and the compensation electrodes to thereby avoid a load from being increased because the compensation electrodes cover the gate line during the scan on the gate line.

It shall be noted that in the pixel structure according to the embodiment of the disclosure, as illustrated in FIG. 2 and FIG. 3, when the n-th gate line gaten is located on the lower side of the n-th row of pixel electrodes 011, the direction from the first gate line to the N-th gate line is the direction from the top side of the base substrate 01 to the bottom side thereof; and as illustrated in FIG. 4 and FIG. 5, when the n-th gate line gaten is located on the upper side of the n-th row of pixel electrodes 011, the direction from the first gate line to the N-th gate line is the direction from the bottom side of the base substrate 01 to the top side thereof.

Optionally, in the pixel structure according to embodiments of the disclosure, as illustrated in FIG. 2 to FIG. 5, the compensation electrodes 012 are arranged at the same layer as the pixel electrodes 011, and made of the same material as the pixel electrodes 011, so that the compensation electrodes 012 and the pixel electrodes 011 can be formed in the same patterning process, that is, the pixel electrodes 011 can be formed simply by modifying the pattern of a mask so that the patterns of the pixel electrodes 011 and the compensation electrodes 012 can be formed without adding any mask process to the related art, to thereby lower a process cost, and save a process period of time.

Optionally, in the pixel structure according to embodiments of the disclosure, as illustrated in FIG. 2 and FIG. 4, the compensation electrodes 012 are structured integral to their corresponding pixel electrodes 011, so that during a scan on the (n−1)-th gate line, the compensation electrodes 012 above the (n−1)-th gate line are connected with the (n−1)-th gate line through the first switch transistors which are switched on, so no capacitor is formed between the compensation electrodes 012 and the (n−1)-th gate line. During a scan on the n-th gate line, both the pixel electrodes 011 and the compensation electrodes 012 are charged to thereby increase a storage capacitance of the electronic paper, and improve the opening ratio of the pixels.

In a particular implementation, since the compensation electrodes 012 are structured integral to their corresponding pixel electrodes 011, a coupling capacitor is created between the n-th row of pixel electrodes 011, and a common electrode on the electronic paper during a scan on the (n−1)-th gate line, so this will be applicable to a product with a small size, or another product with a less strict requirement on a gate line load.

Optionally, in the pixel structure according to embodiments of the disclosure, as illustrated in FIG. 3 and FIG. 5, the pixel structure further includes: second switch transistors T2 corresponding to the respective compensation electrodes 012 in a one-to-one manner.

The compensation electrodes 012 are connected with their corresponding pixel electrodes 011 through their corresponding second switch transistors T2.

Furthermore, in the pixel structure according to embodiments of the disclosure, as illustrated in FIG. 3, the compensation electrodes 012 corresponding to the n-th row of pixel electrodes 011 are connected with second electrodes of the corresponding second switch transistors T2, and the second switch transistors T2 have first electrodes electrically connected with the n-th row of pixel electrodes 011, and gates connected with the n-th gate line gaten, so that during a scan on the (n−1)-th gate line, the compensation electrodes 012 above the (n−1)-th gate line are connected with the (n−1)-th gate line through the first switch transistors which are switched on, so no capacitor is formed between the compensation electrodes 012 and the (n−1)-th gate line, and the compensation electrodes 012 are disconnected from the n-th row of pixel electrodes through the second switch transistors T2, so that the (n−1)-th gate line will not be affected by the n-th row of pixel electrodes; and during a scan on the n-th gate line, both the pixel electrodes 011 and the compensation electrodes 012 are charged to thereby increase a storage capacitance of the electronic paper, and improve the opening ratio of the pixels.

Optionally, in the pixel structure according to embodiments of the disclosure, layers with the same function in the first switch transistors and the second switch transistors are arranged at the same layer to thereby the number of steps in a patterning process.

Optionally, in the pixel structure according to embodiments of the disclosure, the first switch transistor and the second switch transistor are located below the pixel electrodes and/or the compensation electrodes to thereby improve the opening ratio of the pixels as many as possible.

Optionally, in the pixel structure according to embodiments of the disclosure, as illustrated in FIG. 2 to FIG. 5, the widths of the compensation electrodes in the column direction completely cover the widths of the gate lines gate in the column direction, that is, the compensation electrodes 012 cover the gate lines in the width direction of the gate lines gate to thereby increase the areas of the compensation electrodes 012 as many as possible so as to improve the opening ratio of the pixels.

Optionally, in the pixel structure according to the embodiment of the disclosure, as illustrated in FIG. 2 to FIG. 5, the pixel structure further includes: third switch transistors T3 corresponding to the respective pixel electrodes 011 in a one-to-one manner, and data lines "data" corresponding to the respective columns of pixel electrodes 011.

The n-th row of pixel electrodes 011 are connected with second electrodes of their corresponding third switch transistors T3, and the third switch transistors T3 have gates connected with the n-th row gate line gaten, and first electrodes connected with the corresponding data line "data", so that during a scan on the n-th gate line gaten, the corresponding row of third switch transistors T3 are switched on, and the n-th row of pixel electrodes 011 are charged on the data line "data".

Based upon the same inventive idea, some embodiments of the disclosure further provide a method for driving the pixel structure above, the method includes:

providing a scan signal to the respective gate lines gaten in sequence;

while the scan signal is being provided to the n-th gate line, the n-th row of pixel electrodes are connected with their corresponding compensation electrodes, and the compensation electrodes corresponding to the (n+1)-th row of pixel electrodes are connected with the n-th gate line, where n is any integer greater than 1, and less than or equal to N.

Figure 6:
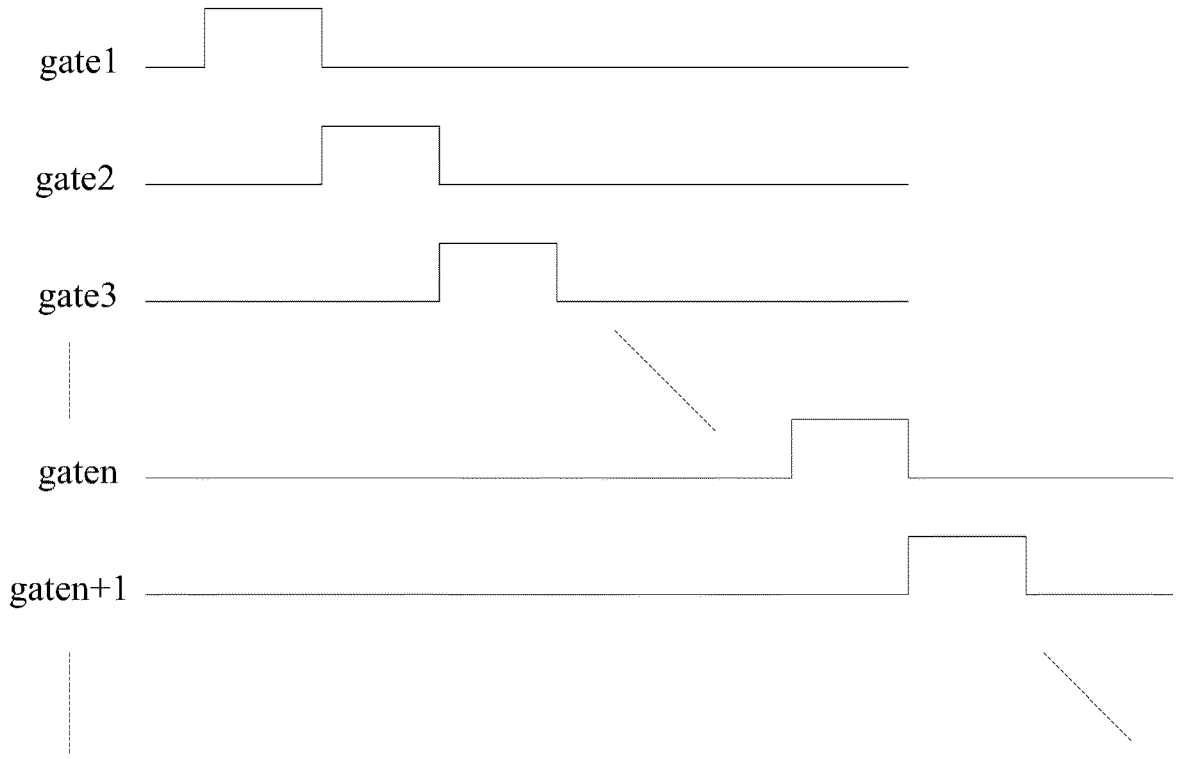
FIG. 6 is a schematic timing diagram of a method for driving the pixel structures as illustrated in FIG. 2 and FIG. 3.
Figure 7:
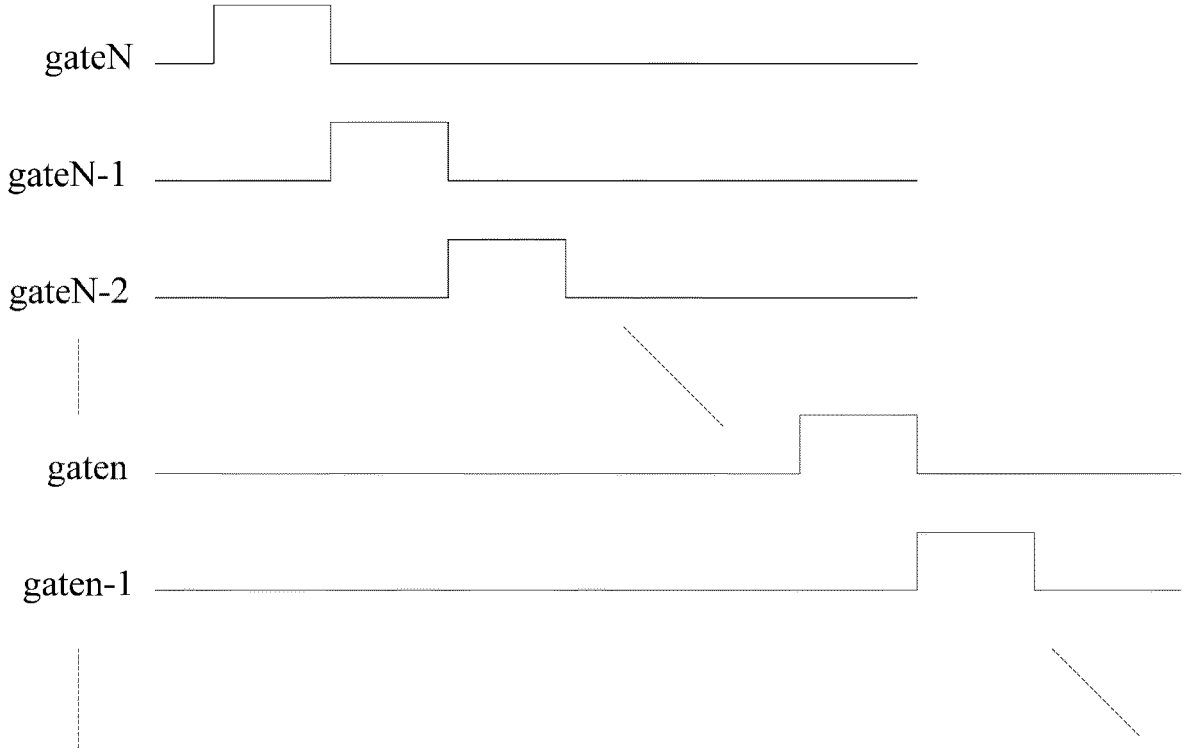
FIG. 7 is a schematic timing diagram of a method for driving the pixel structures as illustrated in FIG. 4 and FIG. 5.

FIG. 6 is a schematic timing diagram of a method for driving the pixel structures as illustrated in FIG. 2 and FIG. 3. FIG. 7 is a schematic timing diagram of a method for driving the pixel structures as illustrated in FIG. 4 and FIG. 5. The explanation will be presented only according to FIG. 6 because of the same working principle. When the n-th gate line is scanned, the n-th gate line is connected with the compensation electrodes corresponding to the (n+1)-th pixel electrodes through the first switch transistors T1 corresponding to the n-th gate line, so that there is no extra capacitance load for the gate line. While the switch transistors T3 and T2 is switched on, the n-th pixel electrodes are connected with the n-th compensation electrodes, and the pixels are charged. When the (n+1)-th gate lines are scanned, the gates of the switch transistors T3 and T2 corresponding to the n-th gate line are switched off, the n-th pixel electrodes and the compensation electrodes enter into a voltage holding status, and the electronic paper presents a color under a current voltage.

Based upon the same inventive idea, some embodiments of the disclosure further provide electronic paper including the pixel structure according any one of the embodiments above of the disclosure. Since the electronic paper addresses the problem under a similar principle to the pixel structure above, reference can be made to the implementation of the pixel structure above for an implementation of the electronic paper, and a repeated description thereof will be omitted here.

In a particular implementation, the electronic paper according to embodiments of the disclosure can be black-white electronic paper, or can be color electronic paper, although the embodiment of the disclosure will not be limited thereto.

Based upon the same inventive idea, some embodiments of the disclosure further provide a display device including the electronic paper above according to the embodiment of the disclosure. The display device can be an electronic book, a digital photo frame, a navigator, an electronic advertisement board, or any other product or component with a display function. Reference can be made to the embodiment of the electronic paper above for an implementation of the display device, and a repeated description thereof will be omitted here.

In the pixel structure, the method for driving the same, the electronic paper, and the display device above according to embodiments of the disclosure, the compensation electrodes electrically connected in correspondence with the respective pixel electrodes are additionally arranged, and there are overlapping areas between the orthographic projections of the compensation electrodes unto the base substrate, and the orthographic projections of the gate lines onto the base substrate, that is, the areas of the pixel electrodes are increased using the compensation electrodes to thereby improve an opening ratio. Furthermore the compensation electrodes corresponding to the n-th row of pixel electrodes are connected with the second electrodes of the corresponding first switch transistors, and the gates and the first electrodes of the first switch transistors are connected with the (n−1)-th gate line, so that during a scan on the (n−1)-th gate line, since the compensation electrodes with areas facing the gate line are connected with the gate line, there is the same voltage of the additional compensation electrodes as the gate line despite the areas thereof facing the gate line, so there is no coupling capacitance between the gate line and the compensation electrodes to thereby avoid a load from being increased because the compensation electrodes cover the gate line during the scan on the gate line.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A pixel structure of electronic paper, comprising: an base substrate, N number of rows of pixel electrodes located on the base substrate, and N number of gate lines connected with respective rows of pixel electrodes in a one-to-one manner, respective gate lines is on upper or lower sides of their corresponding rows of pixel electrodes, wherein the pixel structure further comprises: compensation electrodes connected in correspondence with respective pixel electrodes in a one-to-one manner, and first switch transistors arranged corresponding to respective compensation electrodes in a one-to-one manner, wherein:

the compensation electrodes corresponding to a n-th row of pixel electrodes are on a side of a (n−1)-th row of pixel electrodes proximate to a (n−1)-th gate line, and there are overlapping areas between orthographic projections of the compensation electrodes onto the base substrate and an orthographic projection of the (n−1)-th gate line onto the base substrate, wherein n is an integer greater than 1, and less than or equal to N; N is an integer greater than 1, and the compensation electrodes corresponding to the n-th row of pixel electrodes are directly connected with second electrodes of the first switch transistors, and gates and first electrodes of the first switch transistors are directly connected with the (n−1)-th gate line;

wherein the compensation electrodes are arranged on a layer same as a layer where the pixel electrodes are on, and made of a material same as a material of which the pixel electrodes are made;

wherein the pixel structure further comprises: second switch transistors corresponding to respective compensation electrodes in a one-to-one manner, wherein:

the compensation electrodes are connected with corresponding pixel electrodes through corresponding second switch transistors; and the compensation electrodes corresponding to the n-th row of pixel electrodes are directly connected with second electrodes of corresponding second switch transistors, and the second switch transistors have first electrodes electrically and directly connected with the n-th row of pixel electrodes, and gates directly connected with the n-th gate line.

2. The pixel structure according to claim 1, wherein layers with same function in the first switch transistors and the second switch transistors are arranged at a same layer.

3. The pixel structure according to claim 1, wherein widths of the compensation electrodes in a column direction completely cover width of the gate lines gate in the column direction.

4. The pixel structure according to claim 1, further comprises: third switch transistors corresponding to respective pixel electrodes in a one-to-one manner, and data lines corresponding to respective columns of pixel electrodes, wherein:

the n-th row of pixel electrodes are connected with second electrodes of corresponding third switch transistors, and the third switch transistors have gates connected with the n-th row gate line, and first electrodes connected with the corresponding data line.

5. An electronic paper, comprising the pixel structure according to claim 1.

6. The electronic paper according to claim 5, wherein layers with same function in the first switch transistors and the second switch transistors are arranged at a same layer.

7. The electronic paper according to claim 5, wherein widths of the compensation electrodes in a column direction completely cover width of the gate lines gate in the column direction.

8. The electronic paper according to claim 5, wherein the pixel structure further comprises: third switch transistors corresponding to respective pixel electrodes in a one-to-one manner, and data lines corresponding to respective columns of pixel electrodes, wherein:

the n-th row of pixel electrodes are connected with second electrodes of corresponding third switch transistors, and the third switch transistors have gates connected with the n-th row gate line, and first electrodes connected with the corresponding data line.

9. A method for driving the pixel structure according to claim 1, the method comprising:

providing a scan signal to respective gate lines in sequence, wherein:

while the scan signal is being provided to the n-th gate line, the n-th row of pixel electrodes are connected with corresponding compensation electrodes, and the compensation electrodes corresponding to the (n+1)-th row of pixel electrodes are connected with the n-th gate line, wherein n is an integer greater than 1, and less than or equal to N; N is an integer greater than 1.

10. A display device, comprising an electronic paper, wherein the electronic paper comprises a pixel structure;

wherein the pixel structure comprises an base substrate, N number of rows of pixel electrodes located on the base substrate, and N number of gate lines connected with respective rows of pixel electrodes in a one-to-one manner, respective gate lines is on upper or lower sides of their corresponding rows of pixel electrodes, wherein the pixel structure further comprises: compensation electrodes connected in correspondence with respective pixel electrodes in a one-to-one manner, and first switch transistors arranged corresponding to respective compensation electrodes in a one-to-one manner, wherein:

the compensation electrodes corresponding to a n-th row of pixel electrodes are on a side of a (n−1)-th row of pixel electrodes proximate to a (n−1)-th gate line, and there are overlapping areas between orthographic projections of the compensation electrodes onto the base substrate and an orthographic projection of the (n−1)-th gate line onto the base substrate, wherein n is an integer greater than 1, and less than or equal to N; N is an integer greater than 1, and the compensation electrodes corresponding to the n-th row of pixel electrodes are directly connected with second electrodes of the first switch transistors, and gates and first electrodes of the first switch transistors are directly connected with the (n−1)-th gate line;

wherein the compensation electrodes are arranged on a layer same as a layer where the pixel electrodes are on, and made of a material same as a material of which the pixel electrodes are made;

wherein the pixel structure further comprises: second switch transistors corresponding to respective compensation electrodes in a one-to-one manner, wherein:

the compensation electrodes are connected with corresponding pixel electrodes through corresponding second switch transistors; and the compensation electrodes corresponding to the n-th row of pixel electrodes are directly connected with second electrodes of corresponding second switch transistors, and the second switch transistors have first electrodes electrically and directly connected with the n-th row of pixel electrodes, and gates directly connected with the n-th gate line.

* * * * *